US005294899A

United States Patent [19]

Tanbakuchi

[11] Patent Number: 5,294,899

[45] Date of Patent: Mar. 15, 1994

[54] YIG-TUNED CIRCUIT WITH ROTATABLE MAGNETIC POLEPIECE

[75] Inventor: Hassan Tanbakuchi, Santa Rosa, Calif.

[73] Assignee: Hewlett-Packard Company, Palo Alto, Calif.

[21] Appl. No.: 921,877

[22] Filed: Jul. 29, 1992

[51] Int. Cl.[5] ..... H01P 7/00

[52] U.S. Cl. ..... 333/235; 333/219.2

[58] Field of Search ..... 333/202, 202 M, 219.2, 333/235, 219; 320/95

[56] References Cited

U.S. PATENT DOCUMENTS

| | | | |
|---|---|---|---|
| 4,420,731 | 12/1983 | Schiebold et al. | 333/202 |
| 4,480,238 | 10/1984 | Iwasaki | 333/219.2 |
| 4,667,172 | 5/1987 | Longshore et al. | 333/202 |
| 4,675,630 | 6/1987 | Tang et al. | 333/235 |
| 4,857,871 | 8/1989 | Harris | 333/202 |

FOREIGN PATENT DOCUMENTS

| | | | |
|---|---|---|---|
| 0109714 | 5/1984 | France | 333/219.2 |
| 1566426 | 5/1990 | U.S.S.R. | 333/202 M |

*Primary Examiner*—Raymond A. Nelli
*Attorney, Agent, or Firm*—William C. Milks, III

[57] ABSTRACT

A tunable ferrimagnetic resonator circuit includes a fixed magnetic polepiece, a rotatable magnetic polepiece spaced from the fixed polepiece, an electromagnet for varying a magnetic field between the fixed and rotatable polepieces and a plurality of ferrimagnetic resonators connected in series and located in the magnetic field between the fixed and rotatable polepieces. The ferrimagnetic resonators include an initial resonator having an input port, a final resonator having an output port and one or more intermediate resonators. The rotatable polepiece preferably has a poleface having a first surface region that causes a constant magnetic field to be applied to the intermediate resonators as the polepiece is rotated, and second and third surface regions that cause variable magnetic fields to be applied to the initial and final resonators, respectively, as the polepiece is rotated. The polepiece is rotated to a position where each of the resonators is tuned to substantially the same resonance frequency.

19 Claims, 7 Drawing Sheets

YIG-TUNED CIRCUIT WITH ROTATABLE MAGNETIC POLEPIECE

FIELD OF THE INVENTION

This invention relates to YIG-tuned resonant circuits and, more particularly, to a YIG-tuned resonator circuit having a rotatable magnetic polepiece to insure that each resonator tracks over a frequency range of interest. The invention is particularly useful as a preselector in the front end of a spectrum analyzer, but is not limited to such use.

BACKGROUND OF THE INVENTION

A spectrum analyzer is a scanning receiver that displays power and modulation characteristics of input signals over a specific frequency band. The spectrum analyzer may cover an extremely broad frequency range, for example, 0 to 27 GHz. In the high frequency portion of the range from 2–27 GHz, a superheterodyne receiver is commonly used with a tunable bandpass filter for rejecting images and multiple responses. The bandpass filter is typically a YIG-tuned resonator filter.

YIG-tuned resonator filters comprise a yttrium iron garnet (YIG) sphere suspended between two orthogonal half loop conductors. The YIG material exhibits ferrimagnetic resonance. In the presence of an external DC magnetic field, the dipoles in the YIG sphere align with the magnetic field, producing a strong magnetization.

An RF signal applied to the input half loop conductor produces an alternating magnetic field perpendicular to the DC magnetic field. In the absence of the YIG sphere, the magnetic field is not coupled to the orthogonal output half loop conductor. The dipoles in the YIG sphere precess around the applied DC magnetic field at the frequency of the RF signal when the RF frequency is close to the resonance frequency of the dipoles. The resonance frequency for a spherical YIG resonator is:

$$f_p=\gamma(H_O \pm H_a)$$

where $H_O$ is the strength of the applied DC field in oersteds, $H_a$ is the internal anisotropy field within the YIG material and $\gamma$ is the gyromagnetic ratio (2.8 MHz/oersted).

When an RF signal at or near resonance frequency $f_p$ is applied to the input half loop, the RF signal causes the dipoles in the YIG resonator to precess at the frequency of the RF signal. The precessing dipoles create a circularly polarized magnetic field rotating at the RF frequency in a plane perpendicular to the externally applied DC magnetic field. This rotating field is coupled to the output half loop conductor, inducing an RF signal in the output loop that, at the resonance frequency, is phase shifted 90° from the input RF signal. Because the resonance bandwidth can be made fairly narrow, the YIG resonator makes an excellent filter at RF frequencies. The filter is tunable by varying the strength of the applied DC magnetic field.

YIG-tuned resonator filters typically include three or more YIG-tuned resonators connected in series to obtain a highly selective filter response. Each resonator includes a YIG sphere with input and output half loops. Additional functions may be incorporated into the resonator circuit. For example, a switch associated with the input resonator may be used to switch a low frequency input signal to a low frequency signal processing section of the spectrum analyzer. A harmonic mixer may be used to downconvert the input RF signal to an IF frequency. A tracking YIG-tuned filter-mixer is disclosed in U.S. Pat. No. 4,817,200 issued Mar. 28, 1989 to Tanbakuchi.

In order to obtain optimum performance from the YIG-tuned resonator filter, each resonator should be tuned to the same or nearly the same frequency, and the resonance frequencies should track over the frequency range of interest. Any departure from this requirement produces ripple within the passband of the filter and a generally degraded frequency response. In practice, it has been found that the intermediate resonators of a YIG-tuned filter do not track the input and output resonators, when a uniform magnetic field is applied to all the resonators. Specifically, the intermediate resonators are pulled down in frequency relative to the input and output resonators as the filter is tuned from the lower end of its frequency range toward the upper end.

The pulling of the intermediate resonators relative to the input and output resonators is caused by the double coupling loops used in the intermediate stages. The input RF signal is coupled to the input resonator using a single half loop. Similarly, the output RF signal is coupled from the output resonator using a single half loop. However, the RF signal is coupled to the intermediate resonators using double half loops, which have higher inductance than the single half loops. The higher inductance of the double half loops produces the frequency pulling of the intermediate resonators described above.

In order to insure that the resonators of a YIG-tuned resonant circuit track as a function of frequency, the intermediate resonator or resonators are tuned up in frequency, or the input and output resonators are tuned down in frequency, as the operating frequency increases. One prior art approach is to arrange the resonators in a circle between two magnetic polepieces and to use magnetic polepieces each having a tapered face. Since the magnetic field within the gap varies inversely with the distance between the polepieces, the magnetic field in the gap varies across the faces of the tapered polepieces. By rotating the polepiece, the middle resonator can be tuned with respect to the input and output resonators. In this prior art technique, the entire face of the magnetic polepiece is uniformly tapered. While this approach provides satisfactory performance for a filter having three resonators, its effectiveness decreases for filters with more than three resonators.

A second prior art approach is to use screws embedded in the magnetic polepiece underlying or overlying the input and output resonators. The screws are made of the same magnetic material as the polepiece. By adjusting the screws, the magnetic field applied to the input and output resonators can be varied. The disadvantages of this approach are that the cost of custom magnetic screws is high, the screws usually freeze inside the magnetic polepiece, the screw adjustment, typically on the order of 0.0003 inch, is very hard to control, and the screw can potentially contact and damage the resonator.

It is a general object of the present invention to provide improved YIG-tuned resonator circuits.

It is another object of the present invention to provide YIG-tuned resonator circuits wherein the resonators track over a frequency range of interest.

It is a further object of the present invention to provide a technique for adjusting tracking of YIG-tuned resonator circuits having four or more resonators.

It is yet another object of the present invention to provide YIG-tuned resonator circuits which are low in cost and in which tracking is easily adjusted.

SUMMARY OF THE INVENTION

According to the present invention, these and other objects and advantages are achieved in a tunable ferrimagnetic resonator circuit comprising magnetic means for producing a magnetic field in a gap and a plurality of ferrimagnetic resonators connected in series and located in the magnetic field. The magnetic means includes a rotatable magnetic polepiece. The ferrimagnetic resonators are located in the gap and include an initial resonator having an input port, a final resonator having an output port, and one or more intermediate resonators. The rotatable polepiece has a poleface including a surface region adjacent to each of the resonators, one or more of the surface regions having a first contour that causes a variable magnetic field to be applied to the adjacent resonator as the polepiece is rotated and one or more of the surface regions having a second contour that causes a constant magnetic field to be applied to the adjacent resonator as the polepiece is rotated. The polepiece can be rotated to a position wherein each of the resonators is tuned to substantially the same resonance frequency.

Preferably, a first surface region of the poleface is located adjacent to the one or more intermediate resonators and is substantially flat and lies in a plane perpendicular to the DC magnetic field. Preferably, second and third surface regions of the poleface are located adjacent to the initial resonator and the final resonator, respectively, and are inclined with respect to the direction of the DC magnetic field. The polepiece has an axis of rotation parallel to the DC magnetic field. The first surface region is located within a predetermined radial distance from the axis of rotation. The second and third surface regions are located outside the predetermined radial distance from the axis of rotation.

Each of the ferrimagnetic resonators preferably comprises an input coupling loop for receiving an RF signal, an output coupling loop substantially orthogonal to the input loop and a ferrimagnetic body between the input and output loops for coupling the RF signal from the input loop to the output loop when the frequency of the RF signal is substantially the same as the resonance frequency produced by the magnetic field. The ferrimagnetic body in each of the ferrimagnetic resonators preferably comprises a YIG sphere. The input and output loops of the ferrimagnetic resonators are preferably positioned in alternating directions to form a zigzag pattern.

According to another aspect of the invention, there is provided a method for tuning a ferrimagnetic resonator circuit comprising a magnet for producing a DC magnetic field, a magnetic polepiece and a plurality of ferrimagnetic resonators connected in series and located in the magnetic field. The ferrimagnetic resonators include an initial resonator, a final resonator and one or more intermediate resonators. The method comprises the steps of providing the polepiece with a poleface including a surface region adjacent to each of the resonators, one or more of the surface regions having a first contour that cause a variable magnetic field to be applied to the adjacent resonator as the polepiece is rotated and one or more of the surface regions having a second contour that causes a constant magnetic field to be applied to the adjacent resonator as the polepiece is rotated, and rotating the polepiece about an axis parallel to the magnetic field until a desired frequency response of the ferrimagnetic resonator circuit is obtained.

Preferably, the step of rotating the polepiece includes adjusting the resonance frequencies of the input resonator and the output resonator to be the same or nearly the same as the resonance frequency of the one or more intermediate resonators. Preferably, the resonance frequencies of the resonators are adjusted near the upper end of the operating frequency range.

BRIEF DESCRIPTION OF THE DRAWINGS

For a better understanding of the present invention, together with other and further objects, advantages and capabilities thereof, reference is made to the accompanying drawings, which are incorporated herein by reference and in which.

DETAILED DESCRIPTION OF THE INVENTION

Figure 1:
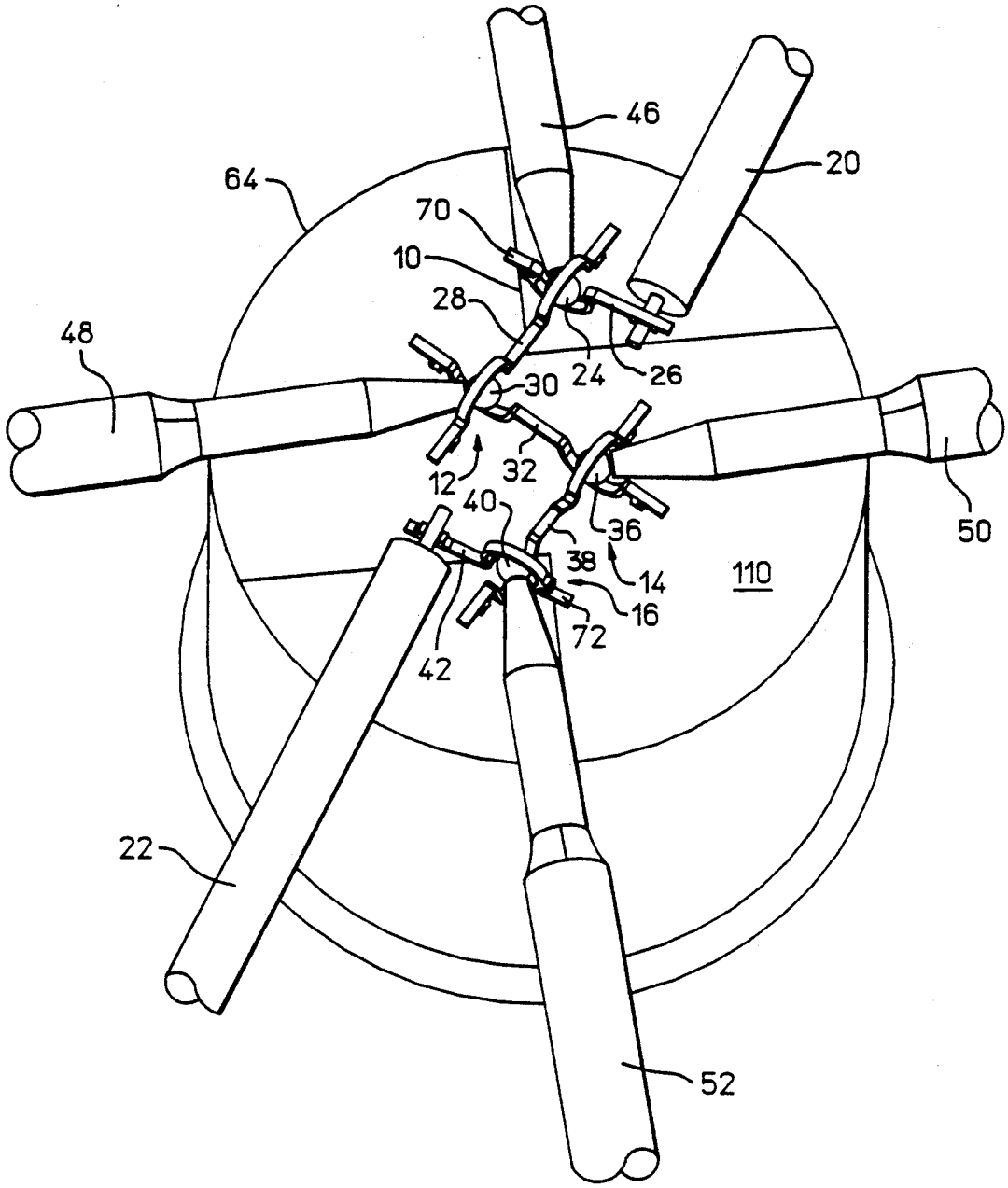
FIG. 1 is a simplified perspective view of a YIG-tuned resonator filter in accordance with the present invention.
Figure 2:
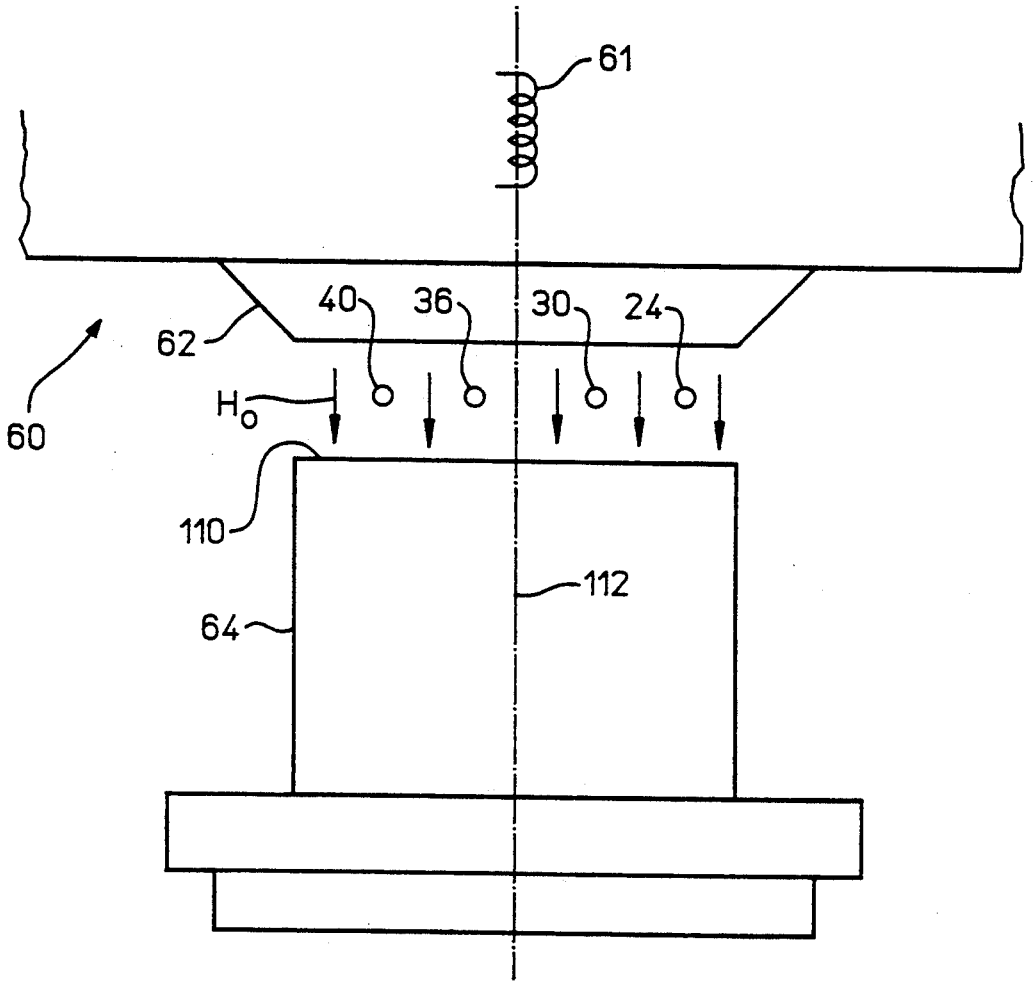
FIG. 2 is a simplified elevational view of a YIG-tuned resonator circuit in accordance with the present invention.

A simplified perspective view of a YIG-tuned resonator filter in accordance with the present invention is shown in FIG. 1. An elevational view of the relationship between the resonators and the magnetic field is shown in FIG. 2. The YIG-tuned resonator filter includes an input resonator 10, an intermediate resonator 12, an intermediate resonator 14 and an output resonator 16. The resonators 10, 12, 14 and 16 are connected in series between an input coax 20 and an output coax 22. Input resonator 10 includes a YIG sphere 24 mounted between an input coupling loop 26 and a coupling loop 28. Resonator 12 includes a YIG sphere 30 mounted between coupling loop 28 and a coupling loop 32. Resonator 14 includes a YIG sphere 36 mounted between coupling loop 32 and a coupling loop 38. Output resonator 16 includes a YIG sphere 40 mounted between coupling loop 38 and an output coupling loop 42.

Each of the coupling loops 26, 28, 32, 38 and 42 is conductive. The input coupling loop 26 and the output coupling loop 42 each comprise a half loop connected to the respective coax. Coupling loops 28, 32 and 38 each comprise a double half loop for interconnecting successive resonators. The input and output coupling loops of each resonator are preferably orthogonal, but can deviate from orthogonal by up to about 10° without significant degradation in performance. The coupling loops 26, 28, 32, 38 and 42 form a zigzag pattern. The YIG spheres 24, 30, 36 and 40 are supported by support rods 46, 48, 50 and 52, which are electrically insulating and nonmagnetic.

As shown in FIG. 2, a DC magnetic field $H_O$ is applied to the resonators 10, 12, 14 and 16 (represented in FIG. 2 by YIG spheres 24, 30, 36 and 40, respectively). The magnetic field $H_O$ is generated by an electromagnet 60. The resonators 10, 12, 14 and 16 are positioned in a gap between a fixed polepiece 62 and a rotatable polepiece 64. The resonators 10, 12, 14 and 16 are typically located in a plane perpendicular to the direction of magnetic field $H_O$. By varying the magnitude of magnetic field $H_O$ through controlling the current flowing in a coil 61 (shown schematically in FIG. 2) in electromagnet 60, the resonance frequency of resonators 10, 12, 14 and 16 is tuned over a desired frequency range. Specifically, as the magnetic field $H_O$ is increased, the resonance frequency is increased.

In a preferred embodiment, the YIG spheres 24, 30, 36 and 40 have diameters of about 0.3 mm, and the radius of each of the coupling loops 26, 28, 32, 38 and 42 is about 0.4 mm. The support rods 46, 48, 50 and 52 are preferably aluminum oxide. The ends of coupling loops 28, 32 and 38 are connected to ground. Similarly, an end 70 of input coupling loop 26 and an end 72 of output coupling loop 42 are connected to ground.

In operation, an input RF signal received on coax 20 causes an RF current to flow through coupling loop 26. The RF current produces an RF magnetic field in the vicinity of YIG sphere 24. In the absence of YIG sphere 24, the RF magnetic field is not coupled to orthogonal coupling loop 28. However, when the applied magnetic field $H_O$ causes YIG sphere 24 to have a resonance frequency that is the same or nearly the same as the frequency of the input RF signal, the RF signal causes the dipoles in YIG sphere 24 to precess and the frequency of the RF signal. The precessing dipoles create a circularly polarized RF magnetic field which is coupled to coupling loop 28. Thus, the resonator 10 passes RF signals having the same or nearly the same frequency as the resonance frequency of YIG sphere 24. Resonators 12, 14 and 16 operate in the same manner to provide a highly selective RF filter. By varying the magnetic field $H_O$ responsive to varying the current through the coil 61 of electromagnet 60, the passband of the filter is tuned over a broad frequency range.

Figure 3:
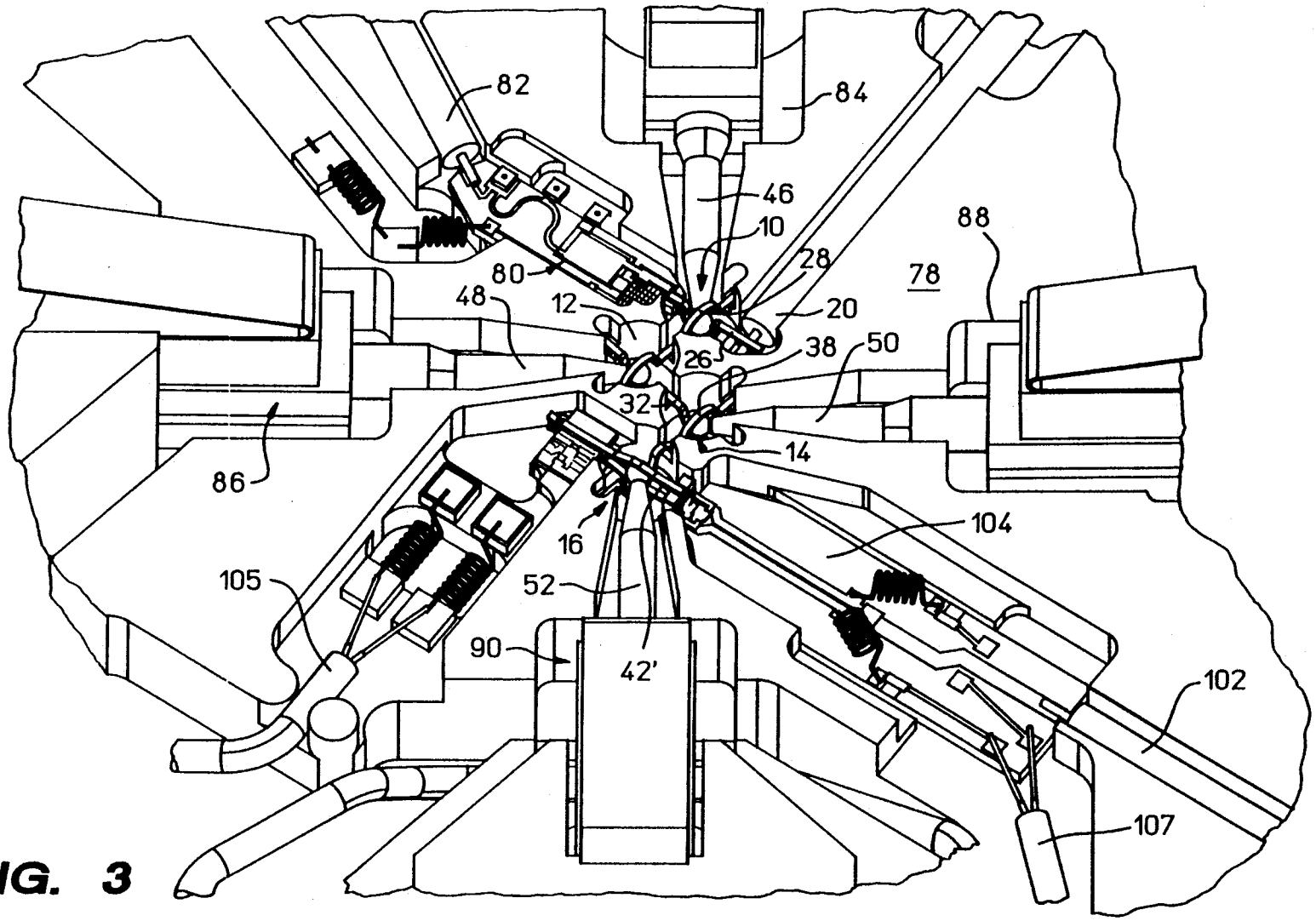
FIG. 3 is a perspective view of a preferred embodiment of a YIG-tuned resonator circuit in accordance with the invention.

A preferred embodiment of a YIG-tuned resonator circuit is shown in FIG. 3. Like elements in FIGS. 1 and 3 have the same reference numerals. The YIG-tuned resonator circuit shown in FIG. 3 comprises a switched YIG-tuned filter and mixer mounted in a conductive chassis 78, typically fabricated of metallized plastic or metallized high resistance metal. The chassis 78 is provided with openings for mounting resonators 10, 12, 14 and 16, and associated circuitry. One end of input coupling loop 26 is connected to coax 20, and the opposite end of coupling loop 26 is connected to an input switch assembly 80. The switch assembly 80 switches input signals in the frequency range of DC to 3 GHz to a low frequency processing section through a coax 82.

YIG sphere support rods 46, 48, 50 and 52 are mounted to sphere positioning assemblies 84, 86, 88 and 90, respectively. The sphere positioning assemblies permit adjustment of the respective sphere positions in three dimensions and rotation of the respective YIG spheres. The sphere positioning assemblies insure that each YIG sphere is centered with respect to the input and output coupling loops. In addition, the sphere positioning assemblies permit the YIG spheres to be rotated so that the crystalline axis of each YIG sphere has a desired orientation with respect to the external DC magnetic field. The sphere positioning assemblies are described in detail in a copending application entitled "YIG Sphere Positioning Apparatus" filed in the name of Thomas W. Finkle and Terry A. Jones, the disclosure of which is hereby incorporated by reference.

In the embodiment of FIG. 3, output resonator 16 comprises an image enhanced harmonic mixer. An LO frequency is applied to the mixer through a coax 102 and a microstrip circuit 104. The IF output of the mixer is divided, depending on whether an even or odd harmonic mixing product is produced, and appears on even IF output balun 105 or odd IF output balun 107. The image enhanced mixer is described in detail in a copending application entitled "Routing YIG-Tuned Mixer" filed in the name of Hassan Tanbakuchi, the disclosure of which is hereby incorporated by reference.

As discussed above, the input resonator 10 and the output resonator 16 are pulled in frequency relative to intermediate resonators 12 and 14 as the resonator circuit is tuned from the lower end of its frequency range toward the upper end. The frequency pulling occurs because the input coupling loop 26 and output coupling loop 42' associated with resonators 10 and 16, respectively, have less inductance than the coupling loops 28, 32 and 38 associated with intermediate resonators 12 and 14. (Coupling loop 42' is a balun structure which during operation has an effective impedance of a single half loop.) The coupling loops 28, 32 and 38 have approximately twice the inductance of coupling loops 26 and 42. In order to overcome the frequency pulling which results from the different inductances in the different resonators, the applied DC magnetic field is adjusted. More specifically, the magnetic fields applied to input resonator 10 and output resonator 16 are preferably reduced relative to the magnetic field applied to intermediate resonators 12 and 14. The reduction in the magnetic fields applied to input resonator 10 and output resonator 16 causes the resonance frequency of these resonators to be equal or nearly equal to the resonance frequency of intermediate resonators 12 and 14. The resonance frequencies then track over the frequency range of interest.

In accordance with the present invention, the resonator configuration shown in FIGS. 1 and 3 is caused to track over the frequency range of interest by providing polepiece 64 with a poleface 110 having a surface contour that applies the required magnetic fields to the resonators 10, 12, 14 and 16. The magnetic flux in the gap between polepieces 62 and 64 (FIG. 2) is given by $H_O L$, where L represents the dimension of the gap between polepieces 62 and 64. Since the magnetic flux is constant, the magnetic field $H_O$ is decreased by increasing the gap L.

Figure 4:
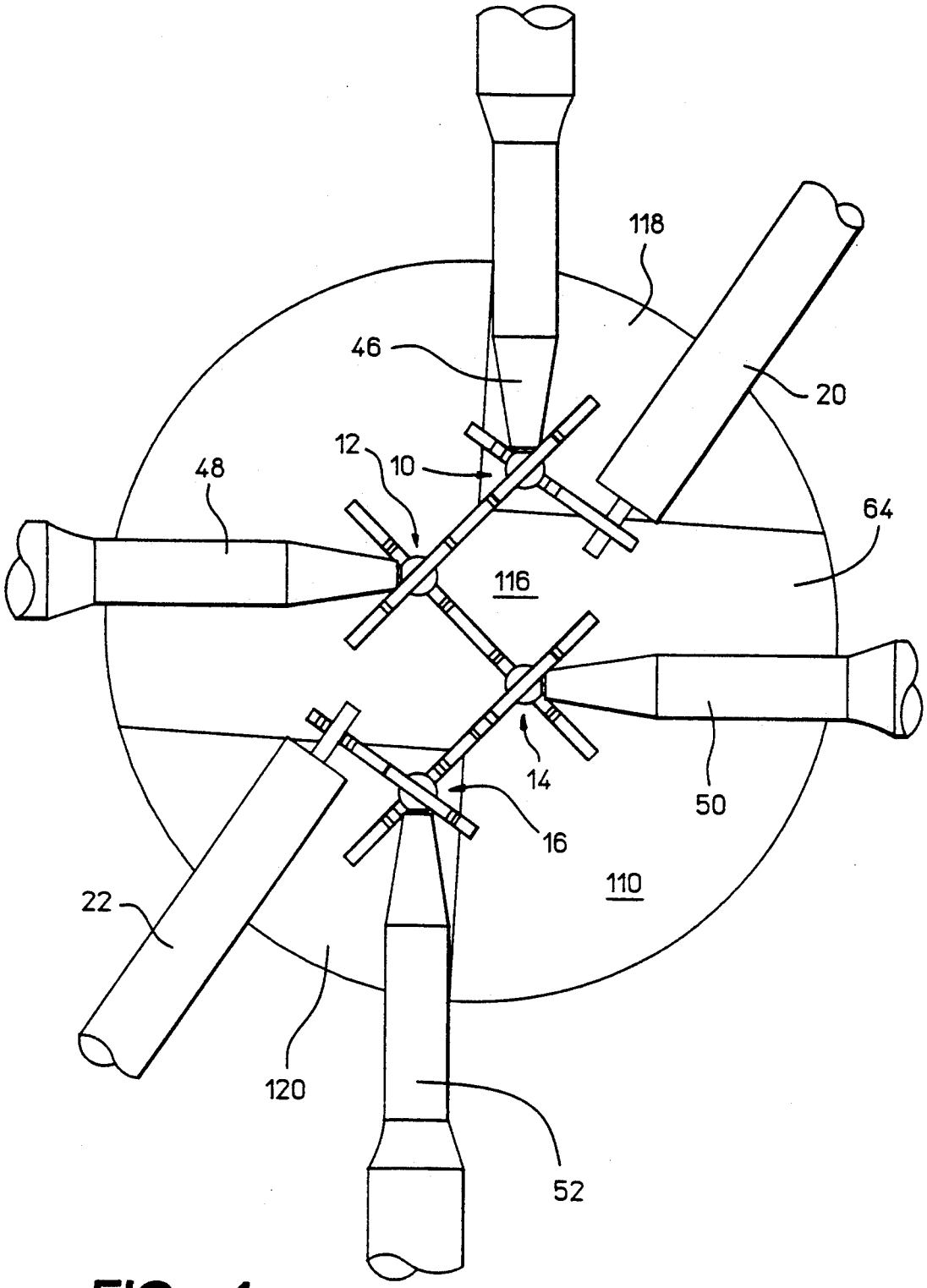
FIG. 4 is a simplified top view of the YIG-tuned resonator circuit shown in FIG. 3 with the chassis removed to show the relationship between the YIG-tuned resonators and the magnetic polepiece.
Figure 6A:
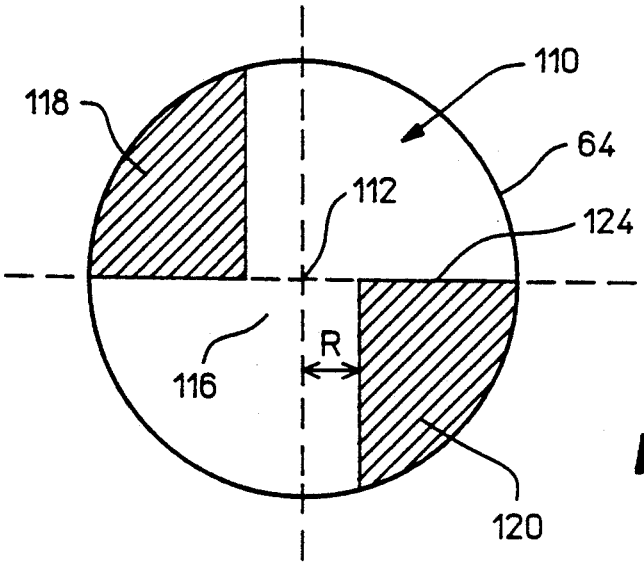
FIG. 6A is a top view of a first embodiment of the polepiece.

The polepiece 64 is rotatable about a central axis 112 (FIG. 2) that is parallel to the direction of the magnetic field $H_O$, As shown in FIGS. 1, 4 and 6A, the poleface 110 of polepiece 64 preferably includes a first surface region 116 having a contour that is substantially flat and lies in a plane perpendicular to axis 112. The first surface region 116 is located adjacent to intermediate resonators 12 and 14. The poleface 110 further includes a second surface region 118 adjacent to input resonator 10 and a third surface region 120 adjacent to output resonator 16. The second and third surface regions 118 and 120 have contours that are inclined downwardly with respect to axis 112 so as to produce a larger spacing from polepiece 62 (FIG. 2) in these regions than the spacing in region 116.

When the polepiece 64 is rotated about axis 112, intermediate resonators 12 and 14 remain over flat surface region 116, and a constant magnetic field is applied to these resonators. However, input resonator 10 is located over inclined surface region 118, and output resonator 16 is located over inclined surface region 120. Thus, as polepiece 64 is rotated about axis 112, variable magnetic fields are applied to input resonator 10 and output resonator 16. The polepiece 64 is preferably rotated until the resonance frequencies of input resonator 10 and output resonator 16 are the same or nearly the same as that of intermediate resonators 12 and 14. When this adjustment is performed at or near the upper end of the frequency range, the resonators track over the frequency range.

Figure 6B:
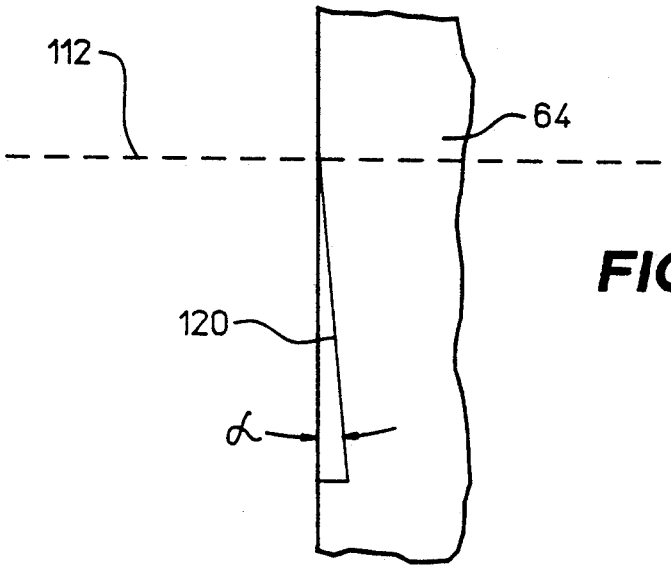
FIG. 6B is a partial cross-sectional view of the polepiece of FIG. 6A, showing one of the inclined surface regions.

The poleface 110 of polepiece 64 is best shown in FIGS. 1, 4, 6A and 6B. The inclined surface regions 118 and 120 are offset from the central axis 112 of poleface 110 by a predetermined radial distance R. As polepiece 64 is rotated about axis 112, the flat surface region 116 remains under intermediate resonators 12 and 14. In a preferred embodiment, the inclined surface regions 118 and 120 are roughly sector shaped. As best shown in FIGS. 6A and 6B, the surface region 120 is inclined downwardly from an edge 124 of surface region 120 at an angle $\alpha$, preferably approximately 1°. The inclined surface region 120 is preferably substantially flat. The surface region 118 preferably has the same configuration as region 120. Thus, as surface regions 118 and 120 are rotated with respect to input resonator 10 and output resonator 16, respectively, the spacing from polepiece 62 (FIG. 2) is varied, and the applied magnetic fields are varied. Preferably, the inclined surface regions 118 and 120 provide about 0.1% adjustment in spacing between polepiece 64 and polepiece 62.

In a preferred embodiment, the polepiece 64 is fabricated of 50% nickel and 50% iron. The polepiece 64 is machined to the desired shape and then is annealed in hydrogen at 1000° F.

For proper operation of the YIG-tuned resonant circuit, the intermediate resonators 12 and 14 must remain adjacent to the flat surface region 116 of poleface 110 as polepiece 64 is rotated. This is achieved by the zigzag pattern illustrated in FIGS. 1 and 4. In particular, the zigzag pattern of coupling loops should meet the following requirements. The input and output coupling loops of each resonator should be substantially orthogonal within about 10° for decoupling of RF signals at frequencies different from the resonance frequency of the resonator. The configuration of resonators should place intermediate resonators 12 and 14 within a predetermined radial distance R from axis 112, and input resonator 10 and output resonator 16 should be located more than the radial distance R from axis 112. Finally, the spacing between successive resonators in the circuit should be minimized. In the preferred embodiment illustrated in FIGS. 3 and 4, the coupling loops in input resonator 10 and output resonator 16 are slightly non-orthogonal to achieve a desired physical layout.

Figure 5:
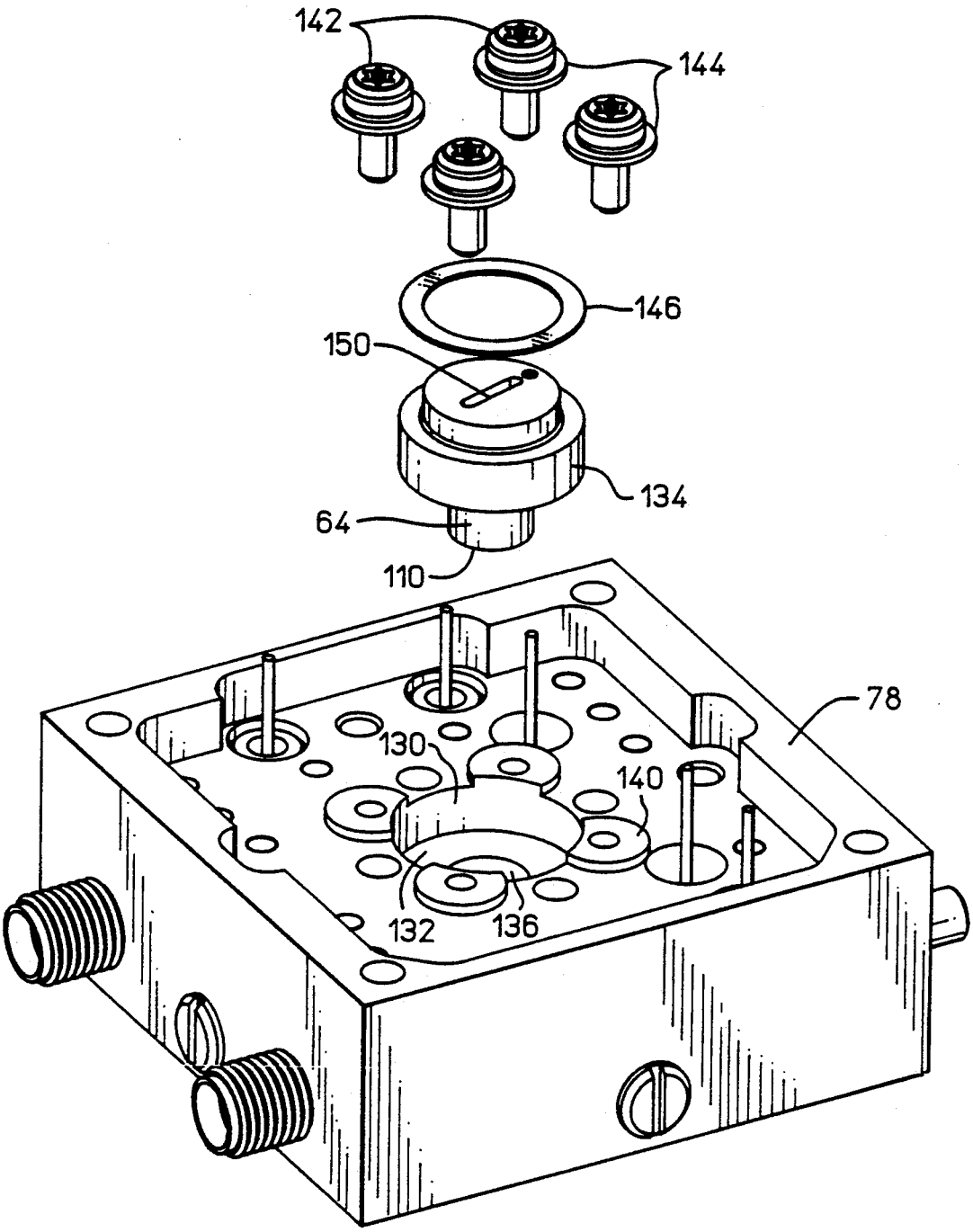
FIG. 5 is an exploded perspective view of the polepiece mounting detail.

An exploded perspective view of a suitable mounting arrangement for polepiece 64 is shown in FIG. 5. The chassis 78, which is partially illustrated in FIG. 3, is inverted in FIG. 5 to show its bottom surface. The chassis 78 is provided with an opening 130 having a shoulder 132 for engaging a collar 134 on polepiece 64. An opening 136 in chassis 78 exposes poleface 110 to resonators 10, 12, 14 and 16, which are mounted on the opposite side of chassis 78 as shown in FIG. 3. The chassis 78 is provided with raised bosses 140 surrounding opening 130. The polepiece 64 is retained in opening 130 by mounting screws 142 and washers 144 which are secured in bosses 140. A spring washer 146 is positioned on collar 134 and spring loads the assembly. The raised bosses 140 permit rotation of polepiece 64 in opening 130. The polepiece 64 includes a slot 150 for engagement with a suitable rotation tool or rotation shaft. The spring washer 146 retains polepiece 64 in a fixed position after adjustment.

In a preferred alignment technique, the YIG-tuned resonant circuit is connected to suitable instrumentation, such as a spectrum analyzer or network analyzer, for monitoring its frequency response, and an RF signal is applied to its input. The filter is tuned to the low end of its range by varying magnetic field $H_O$, and the spheres are rotated to orient the anisotropy field in the spheres in order to obtain a desired filter response. Then, the filter is tuned to the upper end of its frequency range by varying the magnetic field $H_O$, and the polepiece 64 is rotated to obtain the desired filter response. Finally, the filter response is rechecked at the lower end of the tuning range. It has been found that adjustment at the upper and lower ends of the tuning range provides tracking over the frequency range of interest.

Figure 6C:
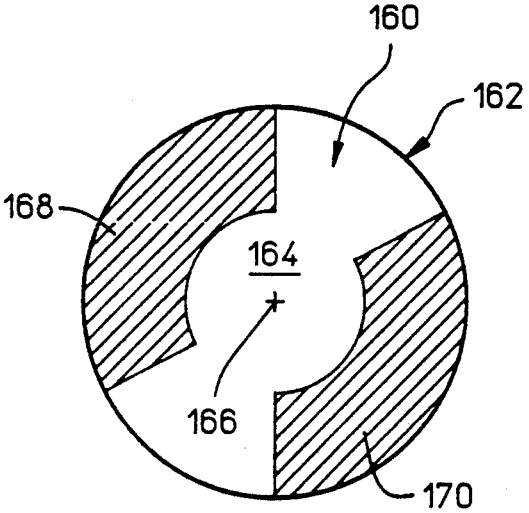
FIG. 6C is a top view of a second embodiment of the polepiece.

A second embodiment of a polepiece in accordance with the present invention is shown in FIG. 6C. A poleface 160 of a polepiece 162 has a central region 164 that is substantially flat in a plane perpendicular to central axis 166. A second surface region 168 and a third surface region 170 located radially outside region 164 are inclined downwardly with respect to axis 166 similarly to the downwardly inclined regions 118 and 120 with respect to axis 112 shown in FIGS. 6A and 6B.

In use, the polepiece 162 is located such that the central surface region 164 is located adjacent to the intermediate resonators 12 and 14 of the resonator circuit. The surface regions 168 and 170 are located adjacent to the input and output resonators 10 and 16, respectively, of the resonator circuit. As the polepiece 162 is rotated, the magnetic fields applied to the input and output resonators are varied as described above.

Figure 7A:
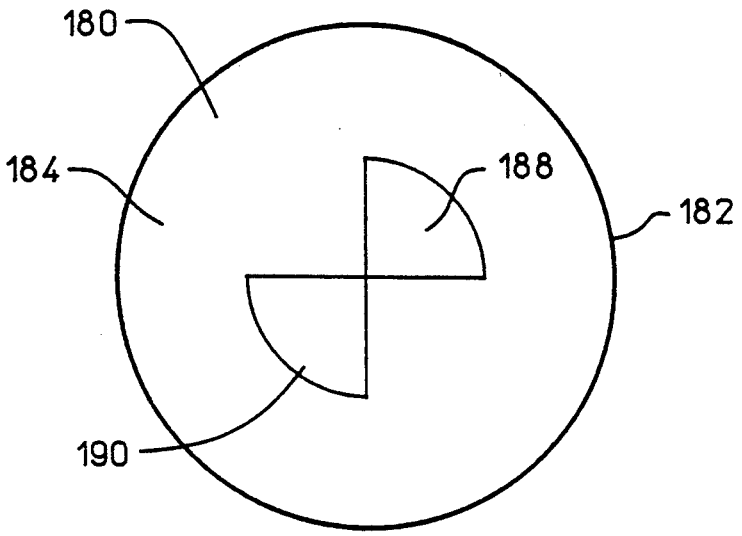
FIG. 7A is a top view of a third embodiment of the polepiece.
Figure 7B:
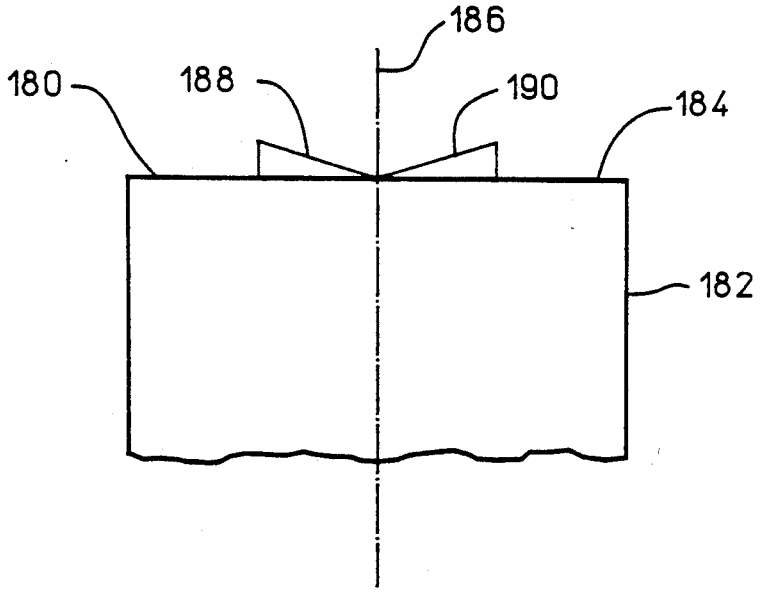
FIG. 7B is a partial elevational view of the polepiece of FIG. 7A.

A third embodiment of a polepiece in accordance with the present invention is shown in FIGS. 7A and 7B. As noted above, the input and output resonators can be tuned down in frequency, or the intermediate resonator or resonators can be tuned up in frequency, to ensure tracking over the operating frequency range. The polepiece of FIGS. 7A and 7B tunes the intermediate resonators up in frequency. A poleface 180 of a polepiece 182 includes an annular outer region 184 that is substantially flat in a plane perpendicular to a central axis 186. A second surface region 188 and a third surface region 190 are located in a circular area within annular region 184. The surface regions 188 and 190 are raised above annular region 180 and are inclined with respect to axis 186.

The polepiece 182 is located such that the surface regions 188 and 190 are adjacent to intermediate resonators 12 and 14. The annular surface region 184 is located adjacent to the input and output resonators 10 and 16. As the polepiece 182 is rotated, the magnetic field applied to the input and output resonators remains constant, and the magnetic fields applied to the intermediate resonators varies. The polepiece 182 is rotated to provide tracking over the operating frequency range as described above.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A tunable ferrimagnetic resonator circuit comprising:

magnetic means for producing a magnetic field in a gap, said magnetic means including a rotatable magnetic polepiece; and a plurality of ferrimagnetic resonators connected in series and located in the magnetic field, including an initial resonator having an input port, a final resonator having an output port and one or more intermediate resonators, for receiving an RF signal at the input port and coupling the input signal to the output port when the frequency of the RF input signal is substantially the same as the resonance frequency produced in the ferrimagnetic resonators by the magnetic field;

said rotatable polepiece having a poleface including a surface region adjacent to each of said resonators, one or more of said surface regions having a first contour that causes a variable magnetic field to be applied to the adjacent resonator as said polepiece is rotated and one or more of said surface regions having a second contour that causes a constant magnetic field to be applied to the adjacent resonator as said polepiece is rotated, such that said polepiece can be rotated to a position wherein each of said resonators is tuned to substantially the same resonance frequency.

2. A tunable ferrimagnetic resonator circuit as defined in claim 1 wherein a first surface region of said poleface is located adjacent to said one or more intermediate resonators and is substantially flat and lies in a plane perpendicular to said magnetic field.

3. A tunable ferrimagnetic resonator circuit as defined in claim 2 wherein second and third surface regions of said poleface are located adjacent to said initial resonator and said final resonator, respectively, and are inclined with respect to the direction of said magnetic field.

4. A tunable ferrimagnetic resonator circuit as defined in claim 3 wherein said gap has a larger dimension in the second and third surface regions than in the first surface region.

5. A tunable ferrimagnetic resonator circuit as defined in claim 3 wherein said polepiece has an axis of rotation parallel to said magnetic field and wherein said second and third surface regions are located more than a predetermined radial distance from said axis of rotation.

6. A tunable ferrimagnetic resonator circuit as defined in claim 1 wherein each of said ferrimagnetic resonators comprises an input conductive loop for receiving an RF signal, an output conductive loop substantially orthogonal to said input loop and a ferrimagnetic body between said input and output loops for coupling the RF signal from the input loop to the output loop when the frequency of the RF signal is substantially the same as the resonance frequency produced by the magnetic field.

7. A tunable ferrimagnetic resonator circuit as defined in claim 6 wherein the input and output loops of said ferrimagnetic resonators are configured in a zigzag pattern.

8. A tunable ferrimagnetic resonator circuit as defined in claim 6 wherein the ferrimagnetic body in each of said ferrimagnetic resonators comprises a YIG sphere.

9. A tunable ferrimagnetic resonator circuit as defined in claim 6 wherein said magnetic means includes an electromagnet for generating said magnetic field.

10. A tunable ferrimagnetic resonator circuit comprising:

a fixed magnetic polepiece;

a rotatable magnetic polepiece spaced from said fixed polepiece;

an electromagnet for producing a magnetic field between said fixed and rotatable polepieces; and a plurality of ferrimagnetic resonators connected in series and located in the magnetic field between said fixed and rotatable polepieces, including an initial resonator having an input port, a final resonator having an output port and one or more intermediate resonators, for receiving an RF signal at the input port and coupling the input signal to the output port when the frequency of the RF input signal is substantially the same as the resonance frequency produced in the ferrimagnetic resonators by the magnetic field, said rotatable polepiece having a poleface including a first surface region adjacent to said one or more intermediate resonators, a second surface region adjacent to said initial resonator, and a third surface region adjacent to said final resonator, said first surface region being substantially flat and lying in a plane perpendicular to said magnetic field, said second and third surface regions being inclined with respect to said magnetic field so that when said polepiece is rotated about an axis parallel to said magnetic field, a constant magnetic field is applied to said one or more intermediate resonators and variable magnetic fields are applied to said initial and final resonators.

11. A tunable ferrimagnetic resonator circuit as defined in claim 10 wherein each of said ferrimagnetic resonators comprises an input conductive loop for receiving an RF signal, an output conductive loop substantially orthogonal to said input loop and a ferrimagnetic body between said input and output loops for coupling the RF signal from the input loop to the output loop when the frequency of the RF signal is substantially the same as the resonance frequency produced by the magnetic field.

12. A tunable ferrimagnetic resonator circuit as defined in claim 11 wherein the input and output loops of said ferrimagnetic resonators are positioned to form a zigzag pattern.

13. A tunable ferrimagnetic resonator circuit as defined in claim 12 wherein the ferrimagnetic body in each of said ferrimagnetic resonators comprises a YIG sphere.

14. A tunable ferrimagnetic resonator circuit as defined in claim 10 wherein said second and third surface regions are located more than a predetermined radial distance from the axis of rotation of said polepiece.

15. A tunable ferrimagnetic resonator circuit as defined in claim 10 wherein said second and third surface regions are inclined so as to permit variation of the spacing between said fixed and rotatable polepieces of about 0.1% as said rotatable polepiece is rotated.

16. A method for tuning a ferrimagnetic resonator circuit comprising a fixed magnetic polepiece, a rotatable magnetic polepiece, a magnet for producing a DC magnetic field between said fixed and magnetic polepieces and a plurality of ferrimagnetic resonators connected in series and located in the DC magnetic field, said ferrimagnetic resonators including an initial resonator, a final resonator and one or more intermediate resonators, said method comprising the steps of:

providing said rotatable polepiece with a poleface including a surface region adjacent to each of said resonators, one more of said surface regions having a first contour that causes a variable magnetic field to be applied to the adjacent resonator as said polepiece is rotated and one or more of said surface regions having a second contour that causes a constant magnetic field to be applied to the adjacent resonator as said polepiece is rotated; and rotating said rotatable polepiece about an axis parallel to said DC magnetic field until a desired frequency response of said ferrimagnetic resonator circuit is obtained.

17. A method for tuning a ferrimagnetic resonator circuit as defined in claim 16 wherein the step of providing said rotatable polepiece with a surface region adjacent to each of said resonators includes providing a first surface region adjacent to said one or more intermediate resonators, a second surface region adjacent to said initial resonator and a third surface region adjacent to said final resonator, said first surface region being substantially flat and lying in a plane perpendicular to said DC magnetic field and said second and third surface regions being inclined with respect to said DC magnetic field.

18. A method for tuning a ferrimagnetic resonator circuit as defined in claim 17 wherein the step of rotating said rotatable polepiece includes adjusting the resonance frequencies of said input resonator and said output resonator to be the same or nearly the same as the resonance frequency of said one or more intermediate resonators.

19. A method for tuning a ferrimagnetic resonator circuit as defined in claim 18 wherein the step of adjusting the resonance frequencies of said input resonator and said output resonator is performed near an upper end of a frequency range of interest.

* * * * *